US012222132B2

(12) United States Patent
Ly et al.

(10) Patent No.: US 12,222,132 B2
(45) Date of Patent: Feb. 11, 2025

(54) PROTECTIVE COVER FOR DUCTLESS MINI SPLIT AIR CONDITIONERS

(71) Applicant: Lacroix Industries, Inc., Auburn, MA (US)

(72) Inventors: Vinh Ly, Worcester, MA (US); Wesley Lacroix, Worcester, MA (US)

( * ) Notice: Subject to any disclaimer, the term of this patent is extended or adjusted under 35 U.S.C. 154(b) by 0 days.

(21) Appl. No.: 18/144,177

(22) Filed: May 6, 2023

(65) Prior Publication Data

US 2024/0302071 A1 Sep. 12, 2024

Related U.S. Application Data

(63) Continuation-in-part of application No. 29/886,675, filed on Mar. 11, 2023, and a continuation-in-part of application No. 29/886,673, filed on Mar. 11, 2023.

(51) Int. Cl.
*F24F 13/20* (2006.01)
*F24F 1/40* (2011.01)

(52) U.S. Cl.
CPC ..... *F24F 13/20* (2013.01); *F24F 1/40* (2013.01)

(58) Field of Classification Search
CPC ..... F24F 1/40; F24F 13/20
See application file for complete search history.

(56) References Cited

U.S. PATENT DOCUMENTS 2,914,075 A * 11/1959 Wells ..... F24F 1/04 62/331
4,730,423 A * 3/1988 Hughes ..... E04H 15/58 52/27
5,341,860 A * 8/1994 Klein ..... F24F 13/24 62/262
5,591,080 A * 1/1997 Ward ..... F24F 7/02 454/366
5,655,382 A * 8/1997 Chen ..... F24F 1/58 53/472
5,916,023 A * 6/1999 Meyer ..... D06F 58/14 34/235
8,357,031 B2 * 1/2013 Dinicolas ..... F24F 1/58 454/201
9,435,561 B2 * 9/2016 Bowen ..... F24F 1/06
9,456,700 B2 * 10/2016 Greener ..... A47C 21/044
9,557,072 B2 * 1/2017 Tolinski ..... F24F 13/20
9,707,881 B2 * 7/2017 Reynolds ..... B60P 3/226
9,845,968 B2 * 12/2017 Couto ..... F24F 13/08
10,072,856 B1 * 9/2018 Akin ..... F24D 12/02
10,267,533 B2 * 4/2019 Mantyla ..... F24F 13/082
10,294,684 B1 * 5/2019 Shedd ..... F24F 1/60
10,447,107 B2 * 10/2019 Miller ..... H02K 9/02
10,487,512 B2 * 11/2019 Bourque ..... F24F 7/02
10,519,981 B2 * 12/2019 Crawford ..... F04D 19/002
11,054,172 B2 * 7/2021 Suriya Prakash ..... F24F 1/58
(Continued)

*Primary Examiner* — Filip Zec

(74) *Attorney, Agent, or Firm* — Law Office of Ilya Libenzon

(57) ABSTRACT

A protective cover for ductless mini split air conditioners is disclosed. The cover includes a front section, a back section, a left section, a right section, and a top section that define a cavity sized for receiving at least a portion of the air conditioner; wherein the top section is sloping gradually downwards from the back section to the front section thereby ensuring that rainwater, snow, ice or other liquids do not accumulate on the cover's surface and cause damage to the air conditioner.

20 Claims, 8 Drawing Sheets

(56) References Cited

U.S. PATENT DOCUMENTS

| | | | | |
|---|---|---|---|---|
| 11,913,653 | B2 * | 2/2024 | Lanthier | F24F 1/58 |
| 2010/0081371 | A1 * | 4/2010 | Dinicolas | F24F 13/20<br>454/275 |
| 2011/0247398 | A1 * | 10/2011 | Breed | G01M 3/26<br>73/40.5 R |
| 2013/0130611 | A1 * | 5/2013 | Dinicolas | F24F 1/58<br>454/201 |
| 2013/0149509 | A1 * | 6/2013 | Federico | C09J 7/29<br>156/247 |
| 2014/0011440 | A1 * | 1/2014 | Savchenko | F24F 13/20<br>454/367 |
| 2017/0074526 | A1 * | 3/2017 | Colantuoni | F24F 1/50 |
| 2017/0108233 | A1 * | 4/2017 | Howard | F24S 10/742 |

* cited by examiner

PROTECTIVE COVER FOR DUCTLESS MINI SPLIT AIR CONDITIONERS

TECHNICAL FIELD

Embodiments disclosed herein relate generally to a protective cover for air conditioners and more specifically to a protective cover for ductless mini split air conditioners.

BACKGROUND ART

Ductless heat pump air conditioners are a popular choice for homeowners who want to efficiently heat and cool their homes. Ductless heat pump air conditioners are designed to be durable and long-lasting, however, these systems can be vulnerable to the elements, particularly during the winter months, when ice and snow can cause significant damage to these units, leading to expensive repairs and even replacement.

During the winter months, heat pumps are at risk of damage from snow and ice buildup. As snow accumulates on the unit, it can block airflow, reducing the efficiency of the heat pump and potentially causing it to overheat. Additionally, as temperatures drop, any moisture on the unit can freeze, leading to ice buildup that can damage the fan blades, compressor, and other components. That is why it is essential to protect these systems from ice and snow buildup and other weather elements.

Commercially available covers are expensive, bulky and very difficult to install. Moreover, they are not effective and efficient in protecting heat pumps from ice and snow buildup and other weather elements.

Therefore, there is a need for a protective cover for heat pump air conditioners that are easy to install, not bulky, inexpensive, and most importantly effective and efficient in protecting heat pumps from the weather elements.

SUMMARY OF THE EMBODIMENTS

The present invention provides a protective cover for ductless mini split air conditioners. The cover includes a front section, a back section, a left section, a right section, and a top section that define a cavity (i.e., empty space) sized for receiving at least a portion of the air conditioner; wherein the height of the back section is larger than the height of the front section causing the top section to slope gradually downwards from the back section to the front section thereby ensuring that rainwater, snow, ice or other liquids do not accumulate on the cover's surface and cause damage to the air conditioner.

In some instances, the cover can include a sound deadening pad disposed on the interior of the top section. The sound deadening pad can be comprised of self-adhesive sound insulation foam. The coverage area of the sound deadening pad can be in the range from 20% to 80% of the area of the top section. The cover can include one or more support members disposed on the interior of the left section or the interior of the right section or both. One or more support members can each include a rubber pad. The support members can be L-shaped. In some instances, the left section or the right section or both can include a recessed area sized for receiving a protruding part of the air conditioner.

According to some embodiments of the present invention, the cover can be powder coated. The color of the cover can match the color of the air conditioner. In some instances, the left section and/or the right section and/or the back section can include one or more holes sized and positioned to match the size and position of a corresponding screw hole disposed on a top portion of the air conditioner thereby allowing to utilize the original factory screws of the air conditioner for ease of attaching thereto.

According to some aspects of the present invention, the top section can slope downwards at an angle ranging from 20 degrees to 50 degrees. In some instances, the cover is made from steel cold rolled sheet metal. The sections of the cover can be seam welded together by the spot-welding process. The cover can be made as one integral part by folding a single sheet of metal into a desired shape and then seam welding the sections of the cover together by spot welding.

In some instances, the left and the right sections of the cover each are having the height of the vertical side proximate to the back section larger than the height of the back section and having the height of the vertical side proximate to the front section equal to the height of the front section. According to some embodiments, the left and the right sections of the cover each are having the height of the vertical side proximate to the back section equal to the height of the back section and having the height of the vertical side proximate to the front section equal to the height of the front section.

Other aspects, embodiments and features of the device and method will become apparent from the following detailed description when considered in conjunction with the accompanying figures. The accompanying figures are for schematic purposes and are not intended to be drawn to scale. In the figures, each identical or substantially similar component that is illustrated in various figures is represented by a single numeral or notation. For purposes of clarity, not every component is labeled in every figure. Nor is every component of each embodiment of the device and method shown where illustration is not necessary to allow those of ordinary skill in the art to understand the device and method.

BRIEF DESCRIPTION OF THE DRAWINGS

The preceding summary, as well as the following detailed description of the disclosed device and method, will be better understood when read in conjunction with the attached drawings. It should be understood, however, that neither the device nor the method is limited to the precise arrangements and instrumentalities shown.

DETAILED DESCRIPTION OF SPECIFIC EMBODIMENTS

Figure 1:
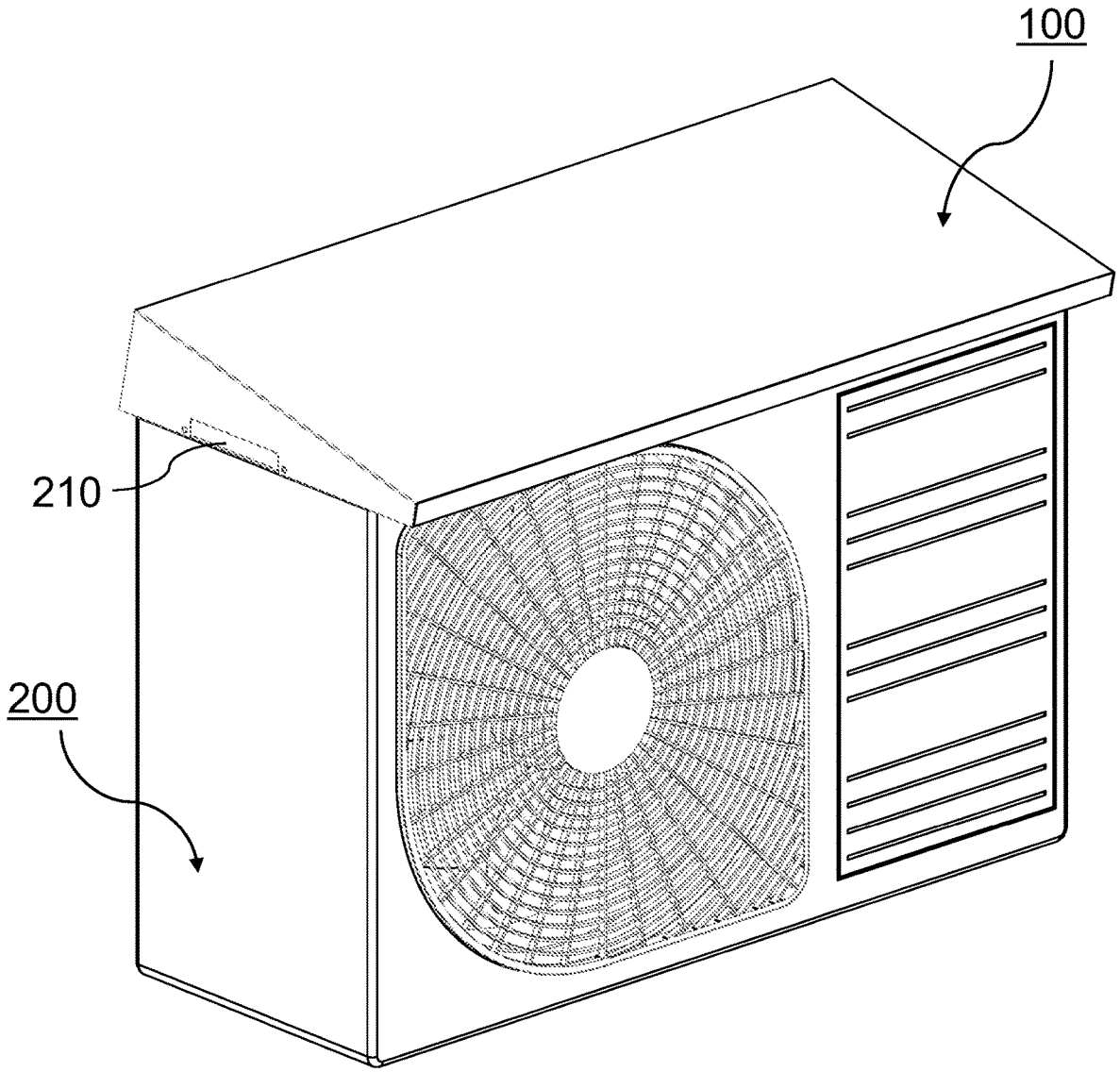
FIG. 1 is a front perspective view of a protective cover installed on a mini split air conditioner.

The present invention provides a protective cover 100 for installing on top of mini split air conditioner 200 as shown in FIG. 1, to protect the air conditioner from ice and snow buildup as well as other weather elements.

Figure 2:
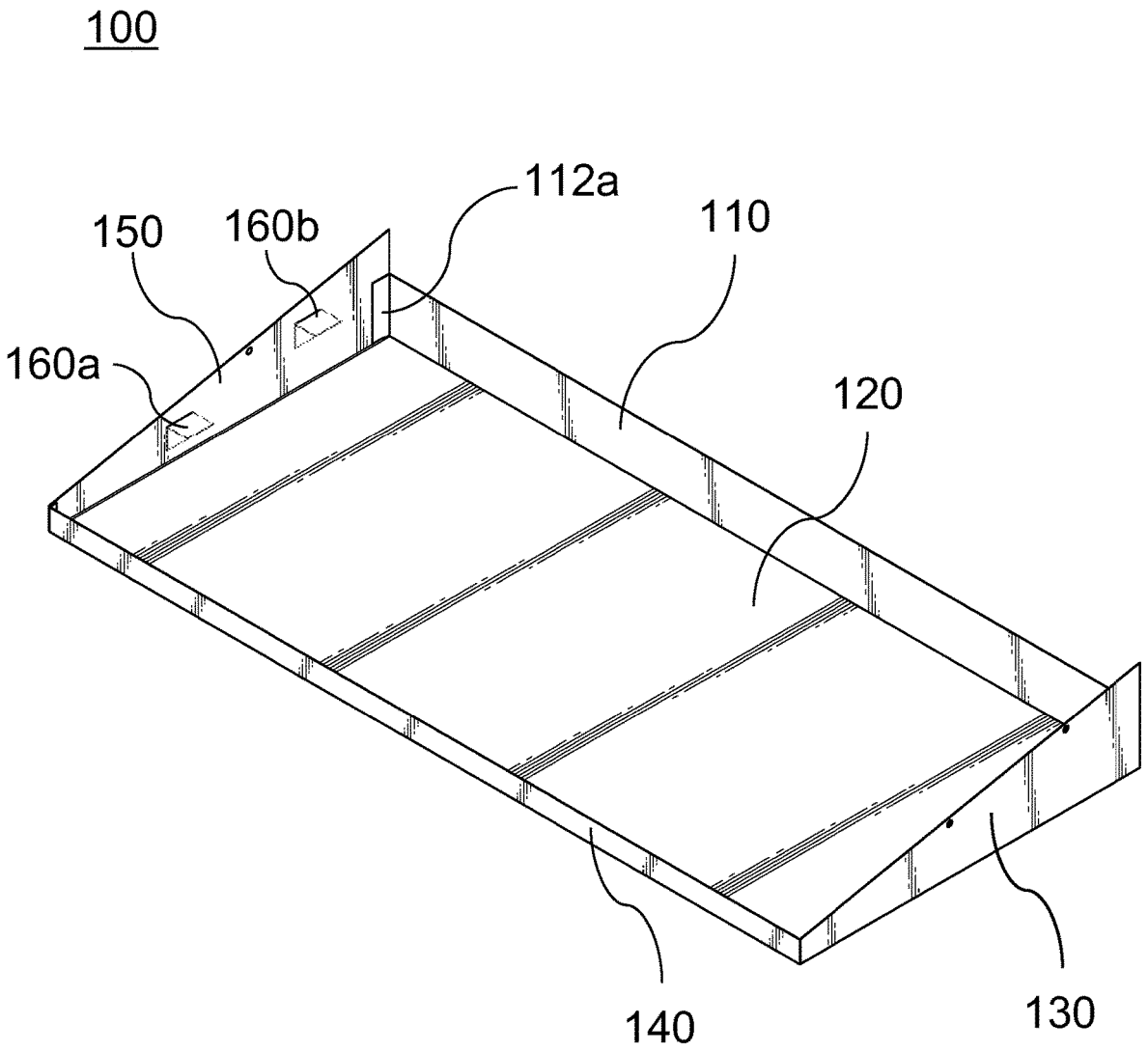
FIG. 2 is a bottom perspective view of the protective cover in accordance with an embodiment of the present invention.
Figure 5:
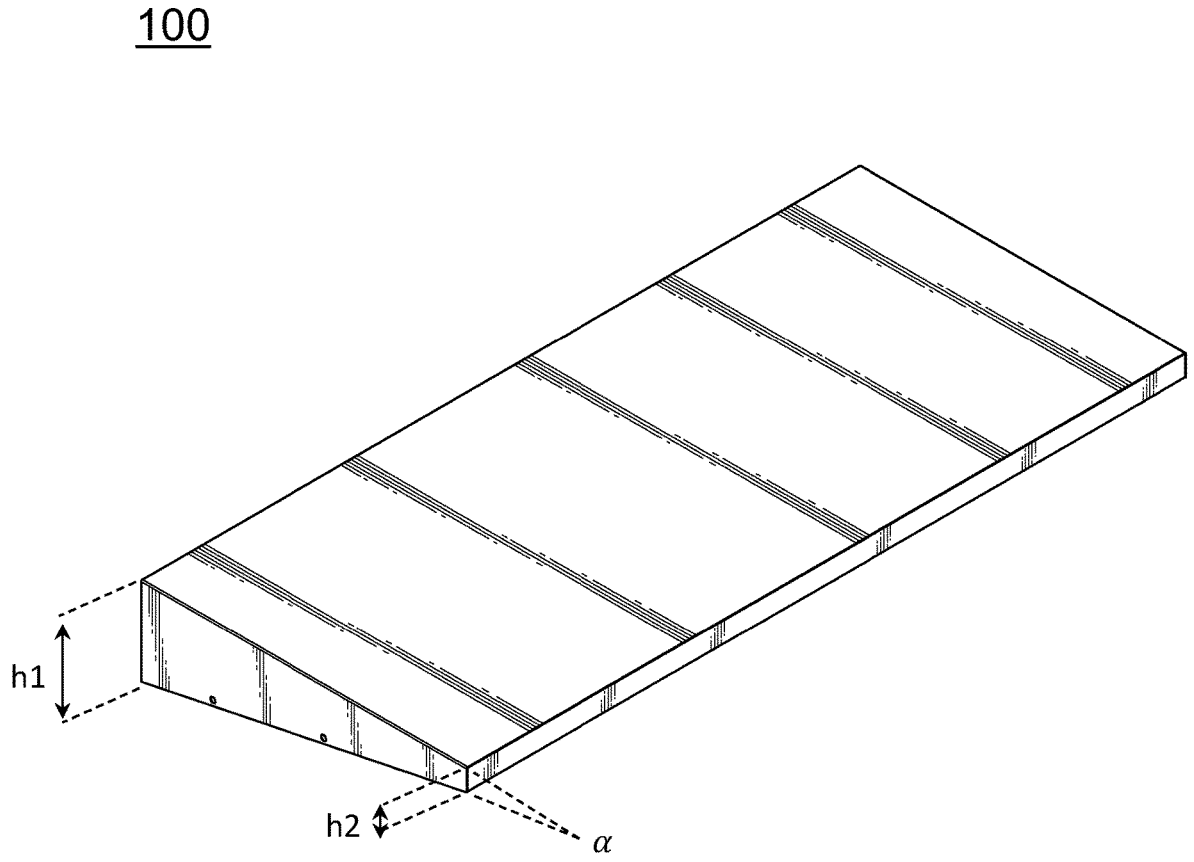
FIG. 5 is a front perspective view of the protective cover.

Referring now to the drawings in detail, and particularly to FIG. 2, there is shown a bottom perspective view of the protective cover 100 of the present invention for installing on ductless mini split air conditioners or other similar units. The cover 100 includes a front section 140, a back section 110, a left section 130, a right section 150 and a top section 120. These five sections define a cavity (i.e., empty space) sized for receiving at least a portion of the air conditioner 200, as shown in FIG. 1. The height h1 of the back section 110 is larger than the height h2 of the front section 140 as further illustrated in FIG. 5, causing the top section 120 to slope gradually downwards from the back section 110 to the front section 140 at a slope angle $\alpha$ thereby ensuring that rainwater, snow, ice or other liquids do not accumulate on the cover's surface and cause damage to the air conditioner. In some instances, the top section 120 can slop downwards at a slope angle $\alpha$ ranging from 20 degrees to 70 degrees, preferably ranging from 20 degrees to 50 degrees. Generally, the angle should be steep enough to ensure that rainwater, snow, ice or other liquids do not accumulate on the cover's surface and cause damage to the air conditioner. In some instances, the height h1 of the back section 110 can vary from 7 cm to 20 cm and the height h2 of the front section 140 can vary from 5 cm to 15 cm, for example h1 can equal to 15 cm and h2 can equal to 8 cm.

Figure 3:
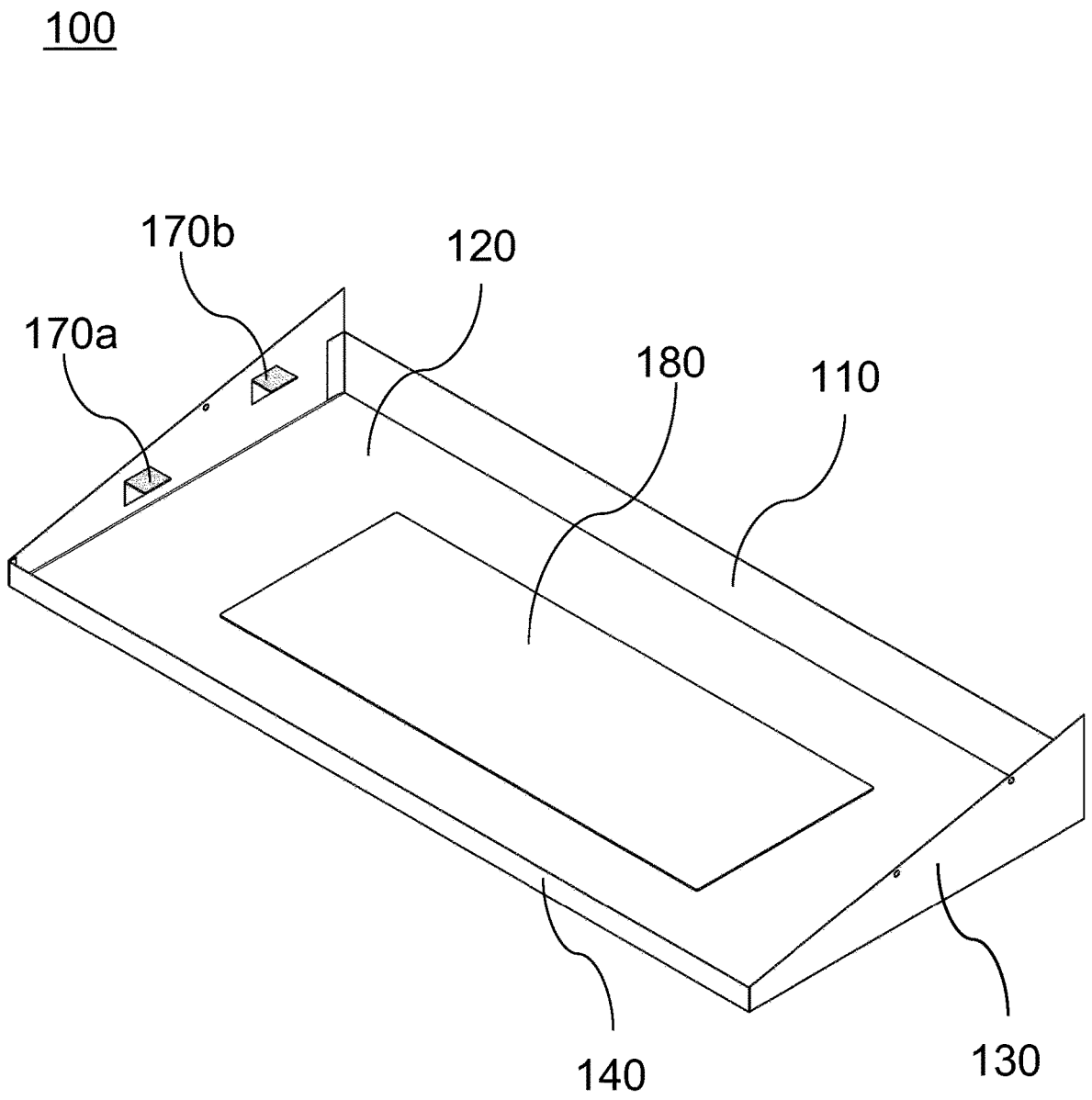
FIG. 3 is a bottom perspective view of the protective cover showing a sound deadening pad and rubber pads disposed on the L-shaped support members.

In some instances, the protective cover of the present invention can include a sound deadening pad 180 disposed on the interior of the top section 120 as shown in FIG. 3, for example. The coverage area of the sound deadening pad can be in the range from 20% to 80% of the interior of the top section 120. The pad can be comprised of self-adhesive sound insulation foam. In accordance with the embodiments of the present invention, the pad 180 should be made from an effective sound absorbing material varying from polyurethane foam, melamine foam, polyester wool, rock wool, glass wool and the like. It can also be made from butyl rubber, which is effective in absorbing and dispersing sounds, cutting down vibrations and acoustics generated by air conditioners. According to some embodiments of the present invention, the protective cover can include a plurality of sound deadening pads disposed on the interior of top section 120.

According to some embodiments of the present invention, the protective cover of the present invention can include a heating pad disposed on the interior of the top section 120. The heating pad can be fixedly attached to the interior of the top section 120 using various attaching means such as glue, adhesive, screws, bolts, staples, and the like, or alternatively can be detachably attached using Velcro, for example. The heating pad is a thermally controlled heating pad with an automatic on/off feature and a manual on/off switch, which would provide both convenience and safety making sure that the undesirable elements such as snow, sleet, and rain are melted off the surfaces of the cover of the present invention. The heating pad is thermally controlled by a thermocouple and configured to turn on automatically at a predetermined temperature, for example at 35 F. The temperature can be in the range from 20 F to 45 F, for example. The heating pad is also configured to shut off automatically after a certain period of time (30 minutes or 40 minutes or 1 hour, for example), and also has an on/off manual switch. The heating pad includes the following components. Heating element, which is the part of the pad that produces the heat. It could be a resistive wire or a ceramic heating element, for example. The thermocouple is a temperature sensor that is used to monitor the temperature of the heating pad. It is typically made of two dissimilar metals that generate a voltage in response to changes in temperature. The control circuit, which receives the output from the thermocouple and uses it to regulate the temperature of the heating pad. It could consist of a microcontroller or other electronic circuitry. The timer, which is used to shut off the heating pad after a certain period of time. This could be a simple mechanical timer or an electronic timer integrated into the control circuit. The on/off switch, which is used to manually turn the heating pad on and off. It could be a simple mechanical switch, or an electronic switch integrated into the control circuit. The manual on/off switch would provide both convenience and safety, for it will allow the user to set a desired temperature and duration of use while ensuring that the pad does not overheat and cause injury or damage to the cover of the present invention and to the heat pump that the cover is designed to protect. The heating pad of the present invention will be configured so that when the on/off switch is turned on, the control circuit monitors the temperature of the pad using the thermocouple. If the temperature is below the predetermined temperature, the heating element is turned on. Once the temperature reaches the predetermined temperature, the control circuit maintains it at that level. If the heating pad is not turned off manually, the timer would shut it off after the predetermined time period. According to some embodiments of the present invention, the protective cover can include a plurality of heating pads disposed on the interior of the top section 120. In some instances, one or more heating pads can be disposed on the interior of the left section or right section or both of the protective cover. In some instances, one or more heating pads can be disposed on the exterior of the top cover or the left section or the right section of the protective cover of the present invention. The cover can be assembled and sold with the one or more heating pads already installed, or in some instances one or more heating pads can be sold as a separate part in a kit comprising the cover and one or more heating pads.

In some instances, the protective cover 100 of the present invention can include one or more support members 160*a*, 160*b* disposed on the interior of the right section 150 as shown in FIG. 2, for example. One or more support members can also be disposed on the interior of the left section 130. In some instances, one or more support members can be disposed on the interior of both the right section 150 and left section 130. The support members 160 can also include rubber pads 170*a*, 170*b* as illustrated in FIG. 3.

Figure 6:
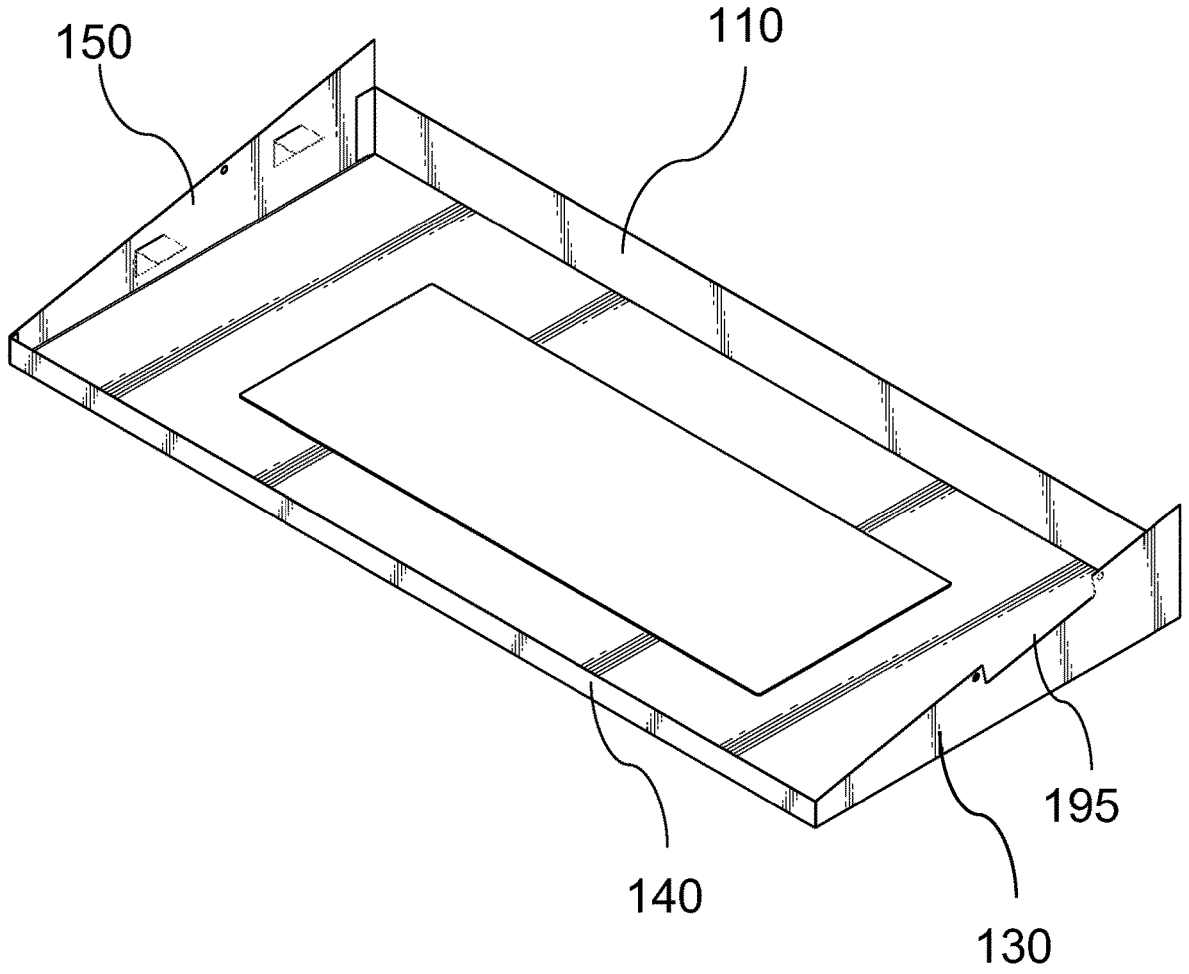
FIG. 6 is a bottom perspective view of the protective cover showing a recessed area formed in the left section of the cover.
Figure 7:
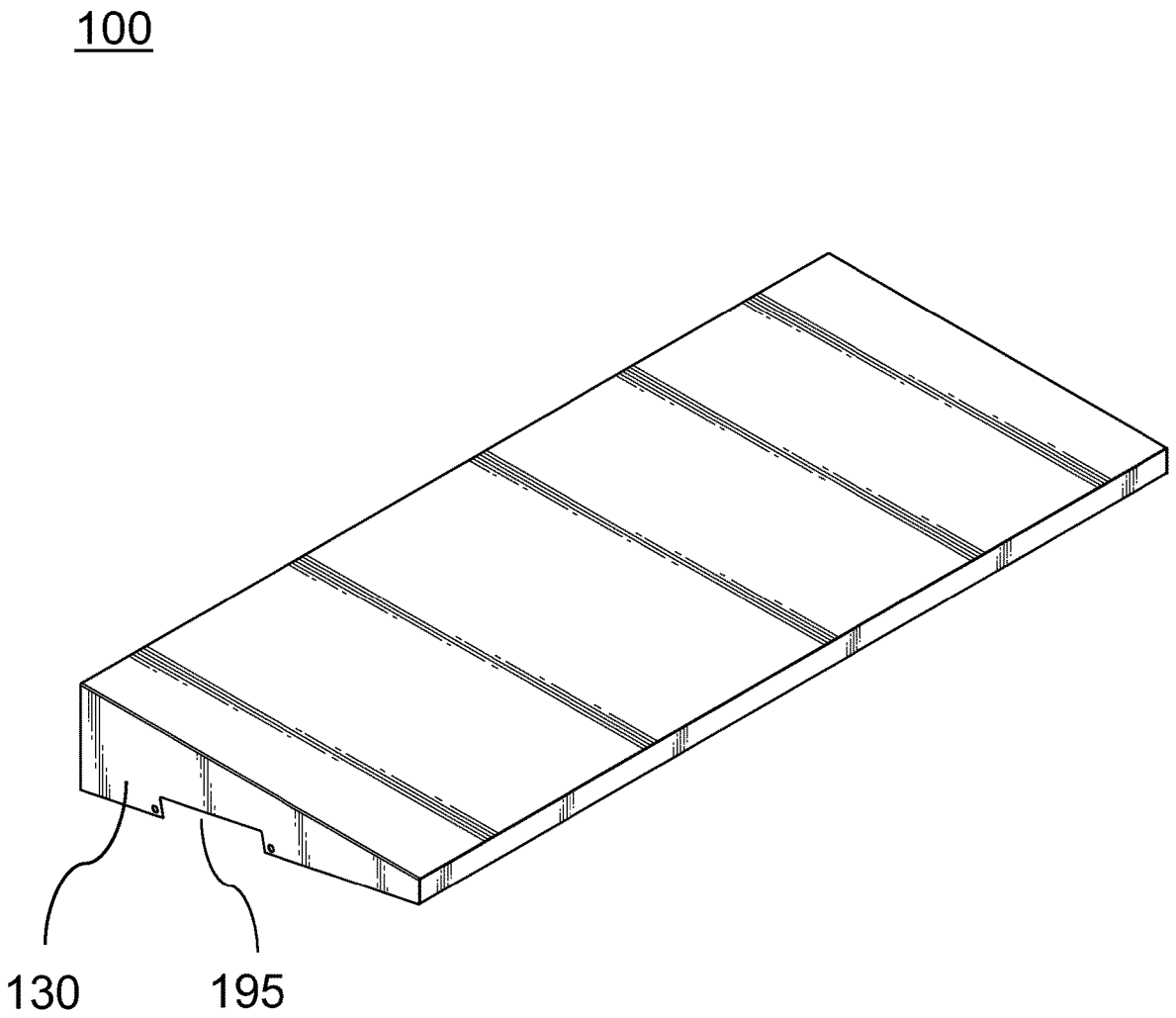
FIG. 7 is a front perspective view of the protective cover showing a recessed area formed in the left section of the cover.

In some instances, a recessed area 195 can be formed in the left section 130, as shown in FIG. 6 and FIG. 7, for example. The recessed area 195 is sized for receiving a protruding part of the air conditioner (part 210 of FIG. 1). In some instances, the recessed area can be formed in the right section 150, and yet in some other instances, the recessed area can be formed in both the right section and the left section.

Figure 4A:
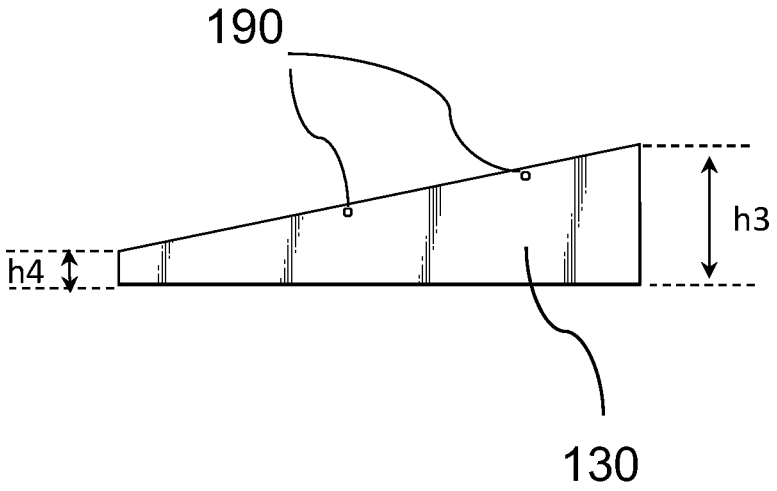
FIG. 4A is a left-side view of the protective cover.
Figure 4B:
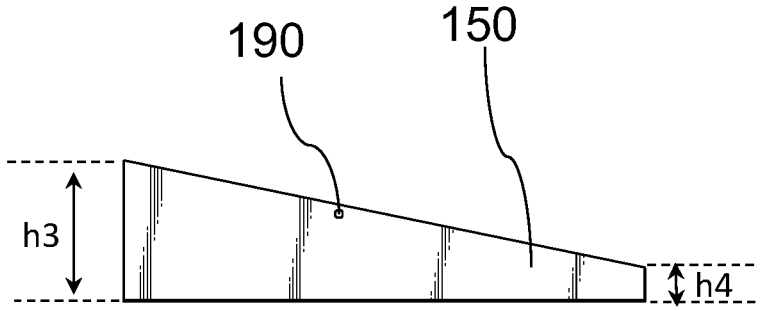
FIG. 4B is a right-side view of the protective cover.

In accordance with some embodiments of the present invention, the protective cover can be made of stainless steel, or any other suitable metal, which can be powder coated to enhance durability. Preferably, the cover can be made from steel cold-rolled sheet metal, having a gauge number ranging from 18 (1.27 mm) to 24 (0.64 mm), and more preferably from 20 (0.95 mm) to 22 (0.8 mm). The color of the cover can match the color of the air conditioner for the purpose of aesthetics. The left section 130 and/or the right section 150 can further include one or more screw holes 190, as shown in FIG. 4A and FIG. 4B, for mounting and attaching the protective cover on top of the air conditioner. The screw holes can also be drilled into the back section 110. One or more screw holes are sized and positioned to match the size and position of a corresponding screw hole disposed on a top portion of the air conditioner thereby allowing to utilize the original factory screws of the air conditioner for attaching the protective cover thereto.

According to some embodiments of the present invention, the cover can be coated with a non-stick hydrophobic spray coating on top of the powder coated layer or instead of the powder coated layer. The non-stick hydrophobic spray coating can be selected from the following types of coatings. Rust-Oleum NeverWet, which is a commercially-available hydrophobic spray coating that can be used on metal surfaces to make them water-repellent. It creates a superhydrophobic barrier that repels water and other liquids, preventing them from sticking to the surface of the cover of the present invention. Spray Coating PTFE (polytetrafluoroethylene), which is a non-stick material that can be be applied as a spray coating to metal and stainless-steel surfaces to create a non-stick and water-repellent barrier. Ceramic coatings are another type of non-stick spray coating that can be applied to metal surfaces. They create a strong, durable barrier that is resistant to water, heat, and chemicals. Silicone spray coatings are often used as a lubricant, but they can also be used as a hydrophobic coating for metal surfaces. They create a non-stick barrier that repels water and other liquids and can be applied to coat the cover of the present invention. It will be understood by a person skilled in the art that, in addition to the spray coating method, the described-above non-stick hydrophobic coatings can be applied to surfaces of the cover of the present invention by other various means, such as brushing or rolling, dipping, electrostatic spraying, powder coating and the like.

In some instances, the left and the right sections (130, 150) each having the height (h3 of FIGS. 4A and 4B) of the vertical side proximate to the back section 110 larger than the height (h1 of FIG. 5) of the back section 110 and having the height (h4 of FIGS. 4A and 4B) of the vertical side proximate to the front section 140 substantially equal to the height (h2 of FIG. 5) of the front section 140.

According to some embodiments of the present invention, the left and the right sections (130, 150) each having the height (h3 of FIGS. 4A and 4B) of the vertical side proximate to the back section 110 substantially equal to the height (h1 of FIG. 5) of the back section 110 and having the height (h4 of FIGS. 4A and 4B) of the vertical side proximate to the front section 140 substantially equal to the height (h2 of FIG. 5) of the front section 140.

The protective cover can be made by assembling and attaching separate sections together using any suitable method, such as welding, for example. It will be understood by a person skilled in the art that the sections of the protective cover can be attached together by other suitable methods, such as bonding them together with an epoxy adhesive, or by riveting, or screwing, or brazing the sections together. The sections can also be attached together by virtue of the self-clinching technology commonly used for sheet metal fabrication. A combination of different sheet metal fabrication techniques can also be employed. For example, some sections can be joined together by welding and some by riveting.

Figure 8:
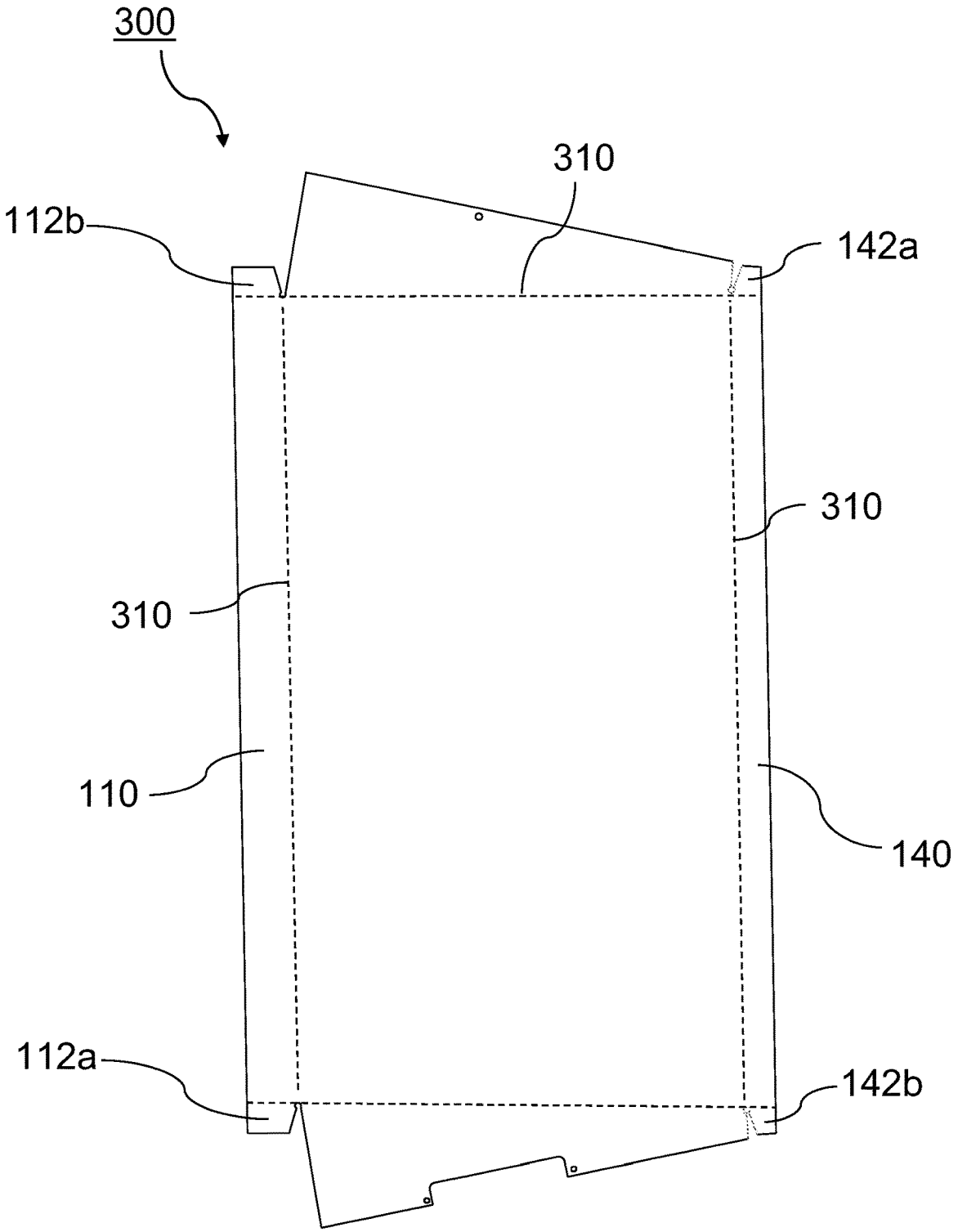
FIG. 8 is a top view of a sheet metal template for forming the protective cover of the present invention.

Alternatively, the cover can be made by folding a single sheet metal 300 along folding lines 310 into a desired shape and seam welding the sections of the cover together by spot welding at folded tabs 112*a*, 112*b*, 142*a*, 142*b*, as shown in FIG. 8, for example, thereby creating a cover as one integral part. As described above, the other sheet metal fabrication methods can be also employed instead of or in addition to the spot welding.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements.

The foregoing detailed description is merely exemplary in nature and is not intended to limit the invention or application and uses of the invention. Furthermore, there is no intention to be bound by any expressed or implied theory presented in the preceding technical field, background, brief summary, or the following detailed description.

What is claimed is:

1. A protective cover for mounting on top of ductless mini split air conditioners comprising:

a front section, a back section, a left section, a right section, and a top section that define a cavity sized for receiving at least a portion of the air conditioner; wherein the height of the back section is larger than the height of the front section causing the top section to slope gradually downwards directly from a top side of the back section to the front section thereby ensuring that rainwater, snow, ice or other liquids do not accumulate on the cover's surface and cause damage to the air conditioner; wherein the left section and the right section each are of trapezoidal shape formed by four sides;

wherein the top, back, and front sections are constructed to be solid, devoid of any grills, flappers, indentations, protrusions or openings, to enhance protection and structural integrity.

2. The protective cover of claim 1, further comprising a sound deadening pad disposed on the interior of the top section.

3. The protective cover of claim 2, wherein the coverage area of the sound deadening pad is in the range from 20% to 80% of the interior of the top section.

4. The protective cover of claim 1, further comprising at least one support member disposed on the interior of the left section or the interior of the right section or both.

5. The protective cover of claim 4, further comprising a rubber pad disposed on the at least one support member.

6. The protective cover of claim 1, wherein at least one of the left section and the right section further comprising a recessed area sized for receiving a protruding part of the air conditioner.

7. The protective cover of claim 1, wherein the interior and exterior of all the sections are powder coated, or spray coated with non-stick hydrophobic coating, or both.

8. The protective cover of claim 1, wherein at least one of the left section, the right section and the back section further comprising at least one screw hole for attaching the cover to the air conditioner.

9. The protective cover of claim 8, wherein the at least one screw hole is sized and positioned to match the size and position of a corresponding screw hole disposed on a top portion of the air conditioner thereby allowing to utilize the original factory screws of the air conditioner for attaching the protective cover thereto.

10. The protective cover of claim 1, wherein the top section is sloping downwards at an angle ranging from 20 degrees to 50 degrees.

11. The protective cover of claim 1, wherein all the sections of the cover are made from steel cold-rolled sheet metal.

12. The protective cover of claim 11, wherein all the sections of the cover are seam welded together by spot welding.

13. The protective cover of claim 11, wherein the cover is forged by folding a single sheet metal into a desired shape and seam welding the sections of the cover together by spot welding thereby creating a cover as one integral part.

14. The protective cover of claim 1, wherein the left and the right sections each having the height of the vertical side proximate to the back section larger than the height of the back section and having the height of the vertical side proximate to the front section equal to the height of the front section.

15. The protective cover of claim 1, wherein the left and the right sections of the cover each are having the height of the vertical side proximate to the back section equal to the height of the back section and having the height of the vertical side proximate to the front section equal to the height of the front section.

16. The protective cover of claim 2, wherein the sound deadening pad is comprised of self-adhesive sound insulation foam.

17. The protective cover of claim 1, wherein the ends of the front section and the back section terminate in folded tabs for attaching the front section and the back section to the left section and the right section; and wherein the attaching is performed by spot welding the folded tabs.

18. The cover of the claim 1, further comprising a thermally controlled heating pad disposed on the interior of the top section and operatively connected to a thermocouple.

19. A protective cover for mounting on top of ductless mini split air conditioners comprising:

a front section, a back section, a left section, a right section, and a top section that define a cavity sized for receiving at least a portion of the air conditioner; wherein the height of the back section is larger than the height of the front section causing the top section to slope gradually downwards directly from a top side of the back section to the front section in a continuous, uninterrupted gradient without any bends, thereby ensuring that rainwater, snow, ice or other liquids do not accumulate on the cover's surface and cause damage to the air conditioner; wherein the top, back, and front sections are constructed to be solid, devoid of any grills, flappers, indentations, protrusions or openings, to enhance protection and structural integrity.

20. A protective cover for mounting on top of ductless mini split air conditioners comprising:

a front section, a back section, a left section, a right section, and a top section that define a cavity sized for receiving at least a portion of the air conditioner; wherein the height of the back section is larger than the height of the front section causing the top section to slope gradually downwards directly from a top side of the back section to the front section in a continuous, uninterrupted gradient without any bends, thereby ensuring that rainwater, snow, ice or other liquids do not accumulate on the cover's surface and cause damage to the air conditioner; wherein the top, back, and front sections are constructed to be solid, devoid of any grills, flappers, indentations, protrusions or openings, to enhance protection and structural integrity; wherein the interior and exterior of all the sections are powder coated with non-stick hydrophobic coating.

* * * * *